US005197629A

United States Patent [19]

Sanchez

[11] Patent Number: 5,197,629

[45] Date of Patent: Mar. 30, 1993

[54] MAILING MACHINE CUT TAPE DISPENSING APPARATUS

[75] Inventor: Jose R. Sanchez, Briarcliff Manor, N.Y.

[73] Assignee: Pitney Bowes Inc., Stamford, Conn.

[21] Appl. No.: 783,585

[22] Filed: Oct. 28, 1991

[51] Int. Cl.[5] ..... B65H 3/00

[52] U.S. Cl. ..... 221/15; 221/231; 221/258; 221/277; 271/116; 271/126; 271/10

[58] Field of Search ..... 271/10, 113, 114, 115, 271/116, 126, 11, 14; 221/15, 231, 258, 277

[56] References Cited

U.S. PATENT DOCUMENTS 2,996,862 8/1961 Johnson et al. ..... 271/116
4,492,315 1/1985 Hooper ..... 221/231
4,513,957 4/1985 Schaefer ..... 271/11
4,715,514 12/1987 Vidondo ..... 221/258
5,056,771 10/1991 Beck et al. ..... 271/114

*Primary Examiner*—H. Grant Skaggs
*Attorney, Agent, or Firm*—Donald P. Walker; Melvin J. Scolnick

[57] ABSTRACT

Apparatus for dispensing a cut tape comprising, structure for receiving a cut tape, structure for feeding the cut tape from the receiving structure, the feeding structure including a solenoid operable for causing the feeding structure to feed the cut tape; and structure for controlling the feeding structure, the controlling structure including a microprocessor, the solenoid electrically connected to the microprocessor, the controlling structure including a switch electrically connected to the microprocessor, and the microprocessor programmed for causing the solenoid to operate in response to actuation of the switch.

13 Claims, 3 Drawing Sheets

MAILING MACHINE CUT TAPE DISPENSING APPARATUS

BACKGROUND OF THE INVENTION

This invention is generally concerned with cut tape dispensing apparatus of the type which is used in a mailing machine, and more particularly with cut tape dispensing apparatus in a mailing machine base which includes structure for operating the tape dispensing apparatus.

As shown in U.S. Pat. No. 4,492,315 for a Mailing Machine Cut Tape Module, issued Jan. 8, 1985 to Clinton E. Hooper and assigned to the assignee of the present invention, it is known in the art to provide a tape feeding module which includes a frame, and includes a receptacle which is slidably connected to the frame for movement relative thereto against the force exerted by a spring. The receptacle is dimensioned for storing a stack of cut tapes, and includes a rack gear which is movable therewith. The module additionally includes a pinion gear which is disposed in meshing engagement with the receptacle's rack gear and is affixed to a shaft journaled to the frame. Moreover, the module includes a roller which is mounted on the shaft and is disposed in tape feeding engagement with the stack. As thus constructed and arranged, the receptacle and thus the rack gear is manually movable, against the force exerted by the spring, for rotating the pinion gear, and thus the roller to feed cut tapes one at a time from the stack.

Customer feedback concerning the manual operating characteristics of cut tape feeding structures, of the type disclosed in the above U.S. Pat. No. 4,492,315, has established that such structures are perceived to be inconvenient and awkward to operate, due to the need to manually move mechanical components against a force exerted by a spring.

Accordingly:

an object of the invention is to provide a mailing machine including improved cut tape dispensing apparatus; and another object is to provide a mailing machine base including cut tape dispensing apparatus and structure for operation thereof.

SUMMARY OF THE INVENTION

Apparatus for dispensing a cut tape comprising, means for receiving a cut tape, means for feeding the cut tape from the receiving means, the feeding means including a solenoid operable for causing the feeding means to feed the cut tape; and means for controlling the feeding means, the controlling means including a microprocessor, the solenoid electrically connected to the microprocessor, the controlling means including a switch electrically connected to the microprocessor, and the microprocessor programmed for causing the solenoid to operate in response to actuation of the switch.

BRIEF DESCRIPTION OF THE DRAWINGS

As shown in the drawings wherein like reference numerals designate like or corresponding parts throughout the several views.

DESCRIPTION OF THE PREFERRED EMBODIMENTS

Figure 1:
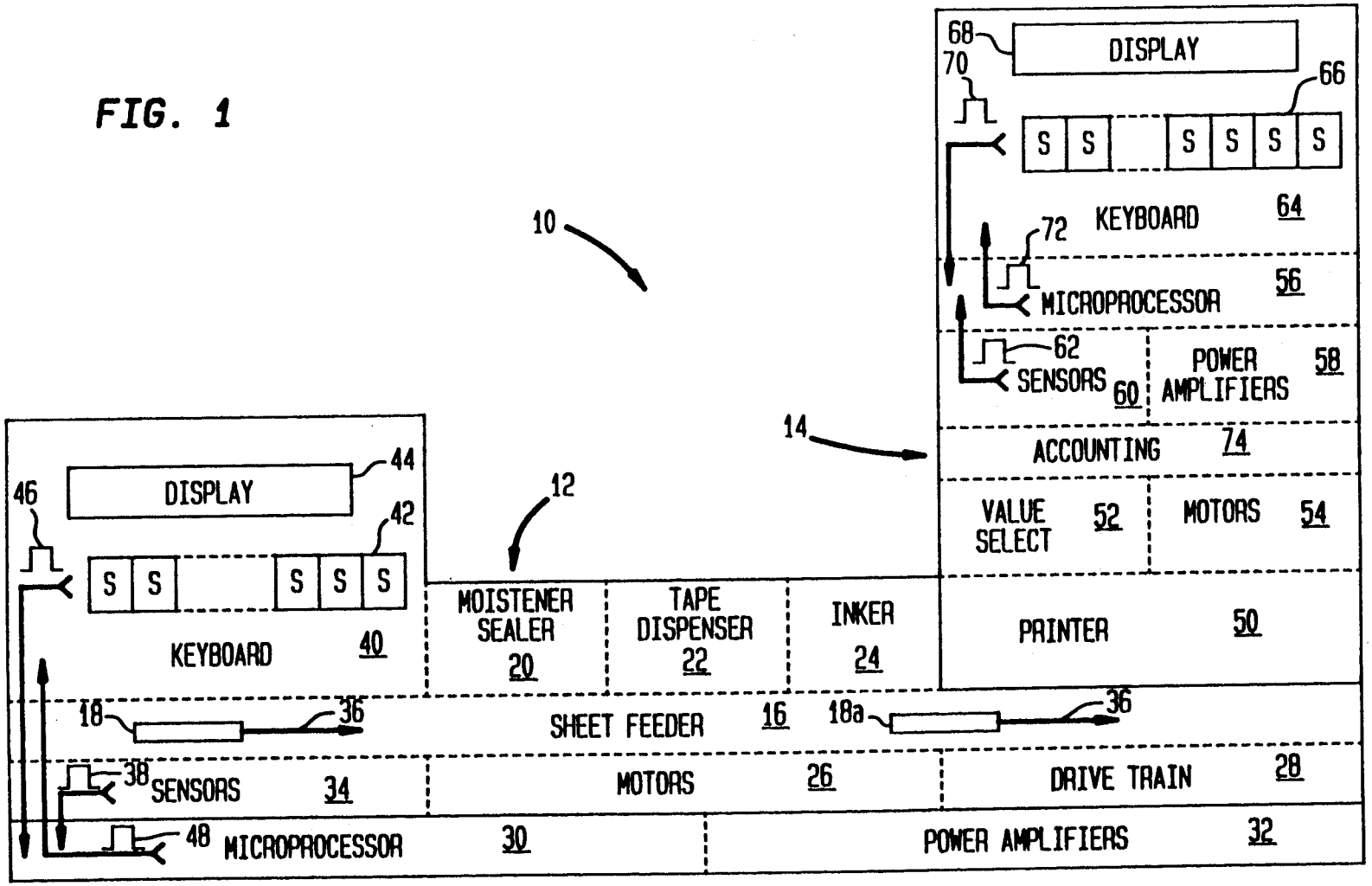
FIG. 1. is a schematic view of a mailing machine according to the invention, including improved cut tape dispensing apparatus.

As shown in FIG. 1, an improved mailing machine 10 according to the invention generally includes an improved mailing machine base 12, and includes a conventional postage meter 14 which is suitably removably connected to the base 12.

The mailing machine base 12 (FIG. 1) preferably comprises conventional sheet feeding structure 16, which may be any suitable structure, such as one or more rollers, belts, or the like, for feeding successive sheets 18 through the machine 10. Without departing from the spirit and scope of the invention a given sheet 18 may be a card, folded or unfolded letter, or sealed or unsealed envelope stuffed with one or more cards, folded or unfolded letters, invoices, remittance slips or return envelopes, cut tapes 18A, or the like. In addition, the mailing machine base 12 preferably comprises conventional envelope moistening and sealing structure 20, including a suitable source of supply of water having a wick immersed therein for transferring water by capillary action therefrom to the gummed surface of the flap of an envelope 18, and including one or more suitable guide walls, or rollers, which may be rollers of the sheet feeding structure 16, for urging the moistened flap into sealing relationship with the body of the envelope. Moreover, the base 12 preferably includes the cut tape dispensing structure 22 hereinafter described in greater detail, and includes conventional inking structure 24, such as a suitable source of supply of ink, which may be a reservoir of ink or an ink saturated roller, and such as one or more roller associated therewith for transferring ink from the ink reservoir to printing structure of a postage meter 14 removably connected to the base 12. Still further, the mailing machine base 12 preferably includes one or more conventional motors 26, which are suitably connected to the sheet feeding structure 16, for operation thereof, and to a conventional drive train 28 which is suitably constructed and arranged for transferring motive power to a postage meter 14 removably connected to the base 12. Moreover, for controlling the mailing machine base 12, the base 12 preferably includes a conventional microprocessor 30, one or more power amplifiers 32 which are respectively connected between the microprocessor 30 and a different motor 26. Further, for controlling the base 12, the base 12 includes a plurality of conventional sensors 34 which are suitably located relative to one or more components of the sheet feeding structure 16, sealing structure 20, inking structure 24, motors 26, drive train 28 and the path of travel 36 of respective sheets 18 fed through the machine 10, for providing signals, such as the signal 38, to the microprocessor 30 which are indicative of the angular velocity of the respective motors 26 or of selected components of the drive train and sheet feeding structures, 16 and 28, are indicative of one or more positions of selected components of the structures 16, 20, 24, 26 and 28, the available supply of water or ink, as the case may be, in the moistening and inking structures, 20 or 24, and are indicative of one or more positions of a given sheet 18, including a given cut tape 18A, in the path of travel 36. Still further, for controlling the mailing machine base 12, the base 12 additionally comprises a conventional keyboard 40, including a plurality of switches 42 and a suitable display 44 which are conventionally electrically connected to the microprocessor 30 for providing thereto conventional signals, such as the signal 46, for causing the microprocessor 30 to control the base 12, and receiving therefrom conventional signals, such as the signal 48, for diving the display 44. And, the microprocessor 30 is conventionally programmed for, inter alia, responding to signals 38 received from the sensors 34, and to signals 46 received from the keyboard 40 due to manual activation of the switches 42, for timely causing operation of the motors 26, and thus of the drive train and sheet feeding structures, 16 and 28, thereby causing respective sheets 18, including cut tapes 18A, to be transported by the sheet feeding structure 16 through the machine 10, and for timely causing the printing structure of the postage meter 14 to print postage indicia, as hereinafter described, on the respective sheets 18.

The postage meter 14 (FIG. 1) preferably comprises conventional postage indicia printing structure 50, such as a conventional rotary printing drum, having a suitable indicia printing die and including a drive shaft, or such as a conventional impact printer, having suitable platen and printing die members, and constructed and arranged for interfacing with the drive train 28 of the mailing machine base 12 when the postage meter 14 is removably connected thereto. For changing the postage value included in the postage indicia, the postage meter 14 additionally includes conventional value selection structure 52, such as a plurality of conventional printing wheels and a drive train therefor, and also includes one or more motors 54, such as stepper motors, which are respectively coupled to the drive trains of the value selection structure 52. In addition, for controlling the postage meter 14, and thus the postage value changing structure 52, the postage meter 14 includes a conventional microprocessor 56, and includes one or more power amplifiers 58 which are respectively connected between the microprocessor 56 and a different motor 54. Further, for controlling the postage meter 14, the meter 14 also includes a plurality of conventional sensors 60 which are suitably located relative to one or more components of the printing structure 50, value selection structure 52, motors 54 and the path of travel 36 of respective sheets 18, including cut tapes 18A, fed through the machine 10, for providing signals, such as the signal 62, to the microprocessor 56 which are indicative of one or more positions of selected components of the structures 50, 52 and 54, and of one or more positions of a given sheet 18, including a given cut tape 18A, in the path of travel 36. Still further, for controlling the postage meter 14, the meter 14 additionally comprises a conventional keyboard 64, including a plurality of suitable switches 66 and a suitable display 68 which are conventionally electrically connected to the microprocessor 56 for providing thereto conventional signals, such as the signal 70, for causing the microprocessor 56 to control the postage meter 14, and for receiving therefrom conventional signals, such as the signal 72, for driving the display 68. Moreover, for controlling the postage meter 14, the meter 14 includes conventional accounting structure 74. The accounting structure 74 is conventionally electrically connected to the microprocessor 56 for communicating therewith, and includes, inter alia, data stored therein which corresponds to the current total value of postage available for printing by the meter 14, the current total value of postage printed by the meter 14 and the serial number of the meter 14. And, for controlling the meter 14, the microprocessor 56 is conventionally programmed for, inter alia, responding to value selection signals 70 received from the keyboard 64, due to manual actuation of the switches 66, for causing the microprocessor 56 to energize the motors 54, thereby causing the value selection structure 52 to position the print wheels to print a postage value corresponding to the value selection signals 70, and for causing the microprocessor 56 to access the accounting structure 74 to determine whether or not sufficient total postage is available for printing and, if so, to deduct therefrom an amount corresponding to the value selection signals 70 and to add the same amount to the total value printed, and, in addition, for the causing the printing structure 50 to be unlocked to permit the printing of single postage indicia, including the amount corresponding to the value selection signals 70, under the control of the postage meter base 12.

According to the invention, the cut tape dispensing structure 22 (FIG. 2) preferably includes suitable framework 80 for supporting the dispensing structure 22 and for defining an elongate, upright, receptacle 82, for receiving a stack 84 of cut tapes 18A. The receptacle 82 includes an elongate, upright, front wall 86, having a generally rectangularly-shaped aperture 88 formed therein which is longitudinally vertically oriented. The receptacle 82 also includes a base wall 90, which is spaced below the lower end 92 of the front wall 86 so as to form therewith an opening 94 therebetween. In addition, the cut tape dispensing structure 22 includes a lug 96, which is conventionally pivotally attached to the framework 80, as by means of a pin 98, and includes an elongate, upright plate 100, which depends from the lug 90 and acts as a back wall for the receptacle 82. Further, the dispensing structure 22 includes an elongate spring 102, for resiliently urging the plate, or back wall, 100, towards the front wall 86. To that end, the spring 102 is looped about the pivot pin 98, has an upper end 104 which is suitably disposed in engagement with a stop 106 extending from the framework 80, and has a lower end 108 which is suitably disposed in engagement with the plate, or back wall, 100, to exert a forwardly directed force 110 against the wall 100 which, in turn, urges the stack 84 of cut tapes 18A towards the receptacle's front wall 86.

For feeding cut tapes 18A (FIG. 2), one at a time, from the receptacle 82, the cut tape dispensing structure 22 preferably comprises cut tape feeding structure 112, including a conventional shaft 114, which is suitably journaled to the framework 80 so as to be spaced forwardly of the receptacle 82 and oriented relative thereto to extend transversely of the receptacle's vertically oriented aperture 88. Further, the tape feeding structure 112 includes a conventional feed roller 116, which is suitably mounted on the shaft 114 by means of a conventional one-way clutch 118 and is dimensioned to extend through the receptacle's aperture 88 for rotation in engagement with the most forwardly disposed cut tape 18A of the stack 84, for feeding successive tapes 18A from the stack 84 and from the receptacle 82 via the receptacle's lower opening 94. To that end, the clutch 118 is conventionally constructed and arranged and connected between the shaft 114 and feed roller 116, to permit the shaft 114 to freely rotate relative to the feed roller 116 when the shaft 114 rotates clockwise 120 as viewed in FIG. 2, and, to cause the feed roller 116 to rotate with the shaft 114 when the shaft 114 rotates counter-clockwise 122 as viewed in FIG. 2. In addition, the cut tape feeding structure 112 includes a pinion gear 124, which is conventionally fixedly attached to the shaft 114 for rotation thereof, and includes a rack gear 126, which is movably connected to the framework 80 and is disposed in meshing engagement with the pinion gear 126 for rotation thereof and thus of the shaft 114. For movably connecting the rack gear 126 to the framework 80, the framework 80 includes a lower a lip portion 130 which has an aperture 132 formed therein. And, the feeding structure 112 includes a rack gear support member 134, having a lower end portion 136, which is slidably mounted in the lip portion's aperture 132, and having an upper end portion 138 to which the rack gear 126 is conventionally fixedly attached for movement with the rack gear support member 134. In addition, the cut tape feeding structure 112 includes a conventional solenoid 140 having a core member, or plunger, 142. Preferably, the solenoid 140 includes a threaded connector portion 144 for threadably attaching the solenoid 140 to an upper lip portion 146 of the framework 80 which is spaced above, and extends parallel to, the framework's lower lip portion 130. Further, the feeding structure 112 includes a helical compression spring 148, which is coaxially mounted on the solenoid's core member 142. And, the lower end 150 of the core member 142 is conventionally secured to the rack gear support member 134, as by means of a pin 152, for movement thereof, and thus of the rack gear 126. As thus constructed and arranged, when the solenoid 140 is electrically operated, the core member 142 and thus the rack gear 126 is moved upwardly thereby against an increasing, downwardly directed, force 154 exerted by the spring 148, as the spring 148 is compressed, between the rack gear support member 134 and solenoid connector portion 144, and energy is stored in the spring 148. As a result, the rack gear 126 rotates the pinion gear 124, and thus the feed roller shaft 114, clockwise as viewed in FIG. 2, the clutch 118 slips and the feed roller 116 remains stationary. Thereafter, when electrical operation of the solenoid 140 is discontinued, the energy stored in the spring 148 causes the spring 148 to expand and exert a decreasing, downwardly directed, force corresponding to the force 154, against the rack gear support member 134. Whereupon, the rack gear 26 rotates the pinion gear 124, and thus the feed roller shaft 114, counter-clockwise as viewed in FIG. 2, to drive the clutch 118 for rotating the feed roller 116 in engagement with the stack 84 of cut tapes 18A to feed the most forwardly located cut tape 18A from the stack 84, and from the receptacle 82 via the lower opening 94 thereof, and into the nip 160 between feed rollers 162 of the sheet feeding structure 16.

For controlling the cut tape dispensing structure 22, and, more particularly, the the feeding structure 112, the dispensing structure 22 preferably comprises controlling structure 170 including the microprocessor 30, and including an additional power amplifier 32 which is electrically connected between the microprocessor 30 and solenoid 140. Preferably, the additional power amplifier 32 is electrically connected to the solenoid 140, as by means a lead 172, for providing thereto signals, such as the signal 174, under the control of the microprocessor 30, for operation of the solenoid 140. Without departing from the spirit and scope of the invention, the additional power amplifier 32 may be an electromechanical relay, or a simple, solid state, switching device or a more complex integrated circuit. In addition, the controlling structure 170 preferably comprises a manually operable switch, which may be a switch 42A, of the array of switches 42 of the keyboard 40, which is conventionally connected to the microprocessor 30 for providing a signal thereto, such as the signal 46, when the switch 42A is actuated. Preferably, however, the cut tape dispensing structure 22 includes a separate, manually-actuatable switch 42B, which is conventionally fixedly mounted on the framework 80 of the cut tape dispensing structure 22 and is suitably electrically connected to the microprocessor 30, as by means of a lead 176, for providing thereto a signal, such as the signal 178, when the switch 42B is actuated.

Figure 2:
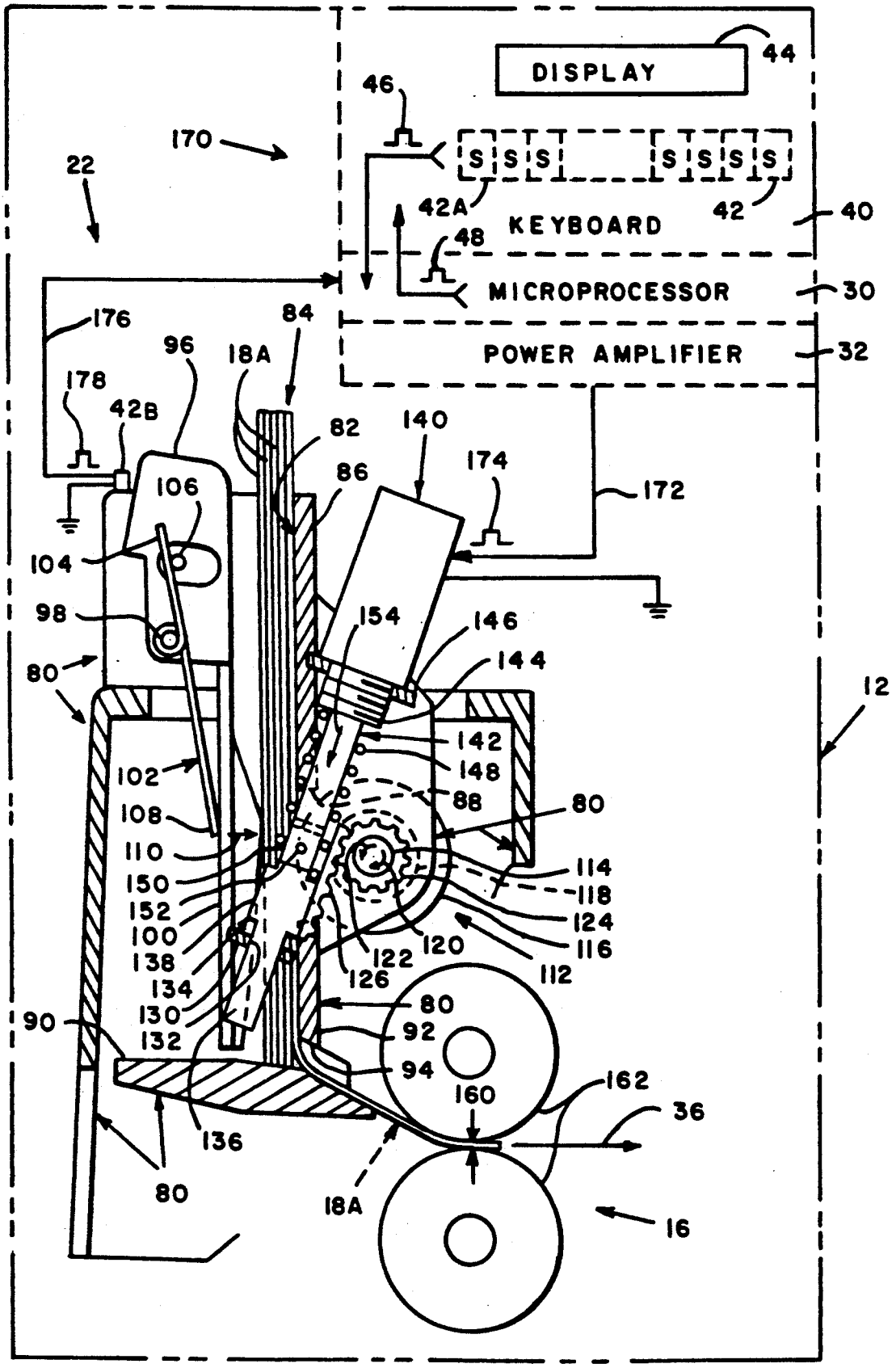
FIG. 2 is a partially fragmentary, and partially schematic, elevation view of cut tape dispensing apparatus according to the invention.
Figure 3:
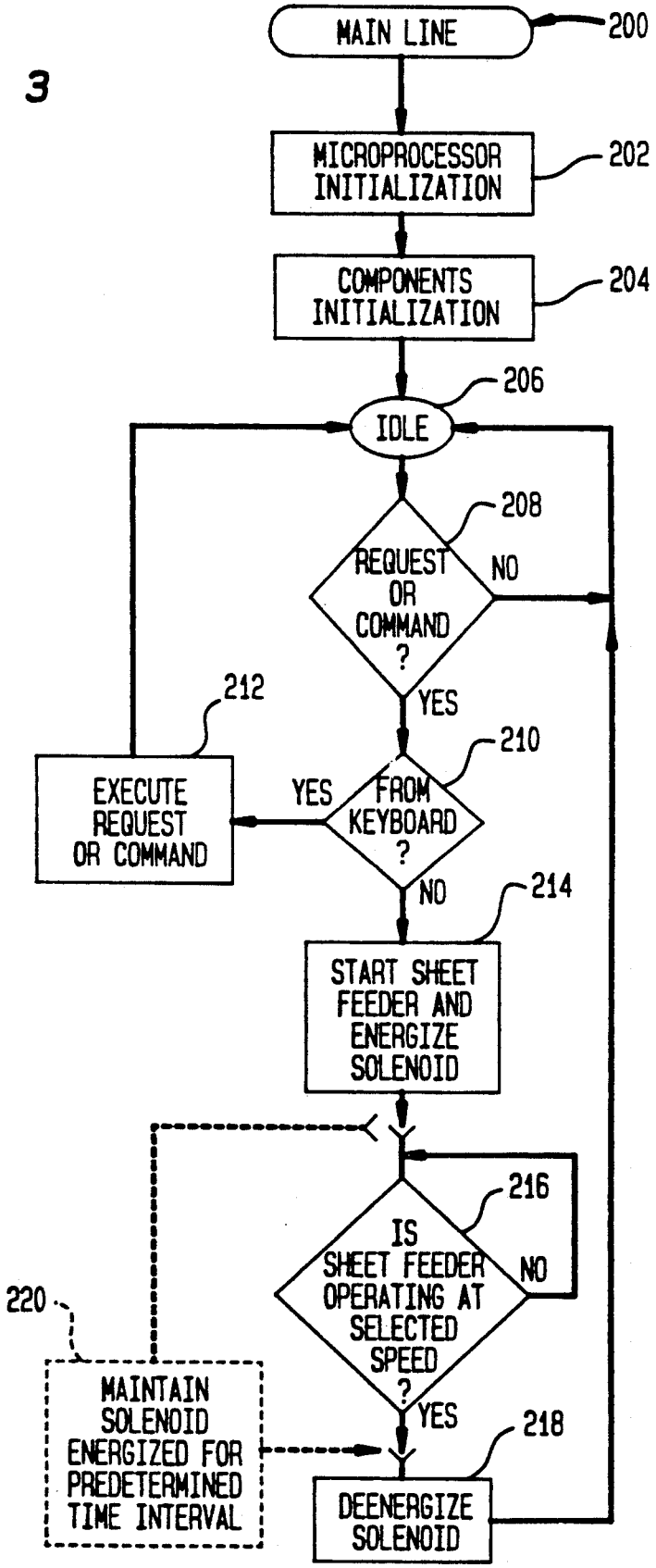
FIG. 3 is a flow chart of a process for operating the cut tape dispensing apparatus according to the invention.

Still further, for controlling the cut tape dispensing structure 22 (FIG. 2) and thus the feeding structures 112, the microprocessor 30 is conventionally programmed for responding to actuation of the switch 42A or 42B, as the case may be, for initiating operation of the sheet feeding structure 16 (FIG. 1) and, thereafter, timely causing operation of the solenoid (FIG. 2). In this connection, as shown in FIG. 3, the microprocessor 30 includes a main line program 200, which commences with the step 202 of conventionally initializing the microprocessor 30. Step 202 generally includes establishing the initial voltage levels at the interface ports utilized for receiving data from various sensors 34 and for controlling the various structures 16, 20, 22, 24, 26, 28, 32 and 44 of the mailing machine base 12, and setting the timers and counters of the microprocessor 30. Thereafter, the microprocessor 30 executes the step 204 of initializing the components of the aforesaid various structures. Step 204 generally entails causing the microprocessor 30 to scan the microprocessor ports connected to the various sensors 34 and, if necessary, to drive the motors 26 or deenergize the solenoid 140 for causing various components of the structures 16, 20, 22, 24, 26, 28 and 32 to be driven to their respective home positions from which operation thereof, and thus of the mailing machine base 12, may be initiated. Assuming completion of the initialization steps 202 (FIG. 3) and 204, then, according to the preferred embodiment of the invention, the program 200 enters into an idle loop routine 206 which commences with the step 208 of determining whether or not a request or command has been received, and, assuming that it has not been received, step 208 (FIG. 3), the program 200 loops to idle, step 206, and reiterates step 208 until a request or command is received. Whereupon, the program 200 implements the step 210 of determining whether or not the request or command is from the keyboard 30 (FIG. 2), other than from the tape switch 42A assuming the provision thereof. Assuming that it is, the program 200 (FIG. 3) implements the step 212 of causing the microprocessor 30 to execute the request or command, for example, by causing operation of one or more of the motors 26, power amplifiers 32 and the drive train 28, and of the sheet feeder 16, moistener/sealer 20, inking structure 24 and display, depending on the content of the request or command, in consideration of appropriate input signals 38 from the sensors 34. However, assuming that the request or command is not from the keyboard, step 210, as noted above, then, according to the invention, the request or command is a signal 178 (FIG. 2) from one or the other of the tape switches 42A or 42B, due to manual actuation thereof, and the program 200 (FIG. 3) implements the step 214 of causing the sheet feeder 16 (FIG. 1) to commence operation, by causing the appropriate motor 26 and drive train 28 coupled thereto to be operated, and preferably, causing the solenoid 140 to be energized, for example by energizing the power amplifier 32 with a series of pulses, for operating the solenoid 140. Thereafter, in one embodiment, the program 200 (FIG. 3) implements the step 216 of making a determination as to whether or not the sheet feeding speed is at a selected level, for example by sensing the angular velocity of the output shaft of the appropriate motor 26 (FIG. 2) or the angular velocity of a component of the drive train 28 connected between that motor 26 and the feed rollers 162 and, by thereafter comparing data corresponding to the sensed angular velocity to data stored in the microprocessor 30 which corresponds to the selected speed. Assuming the sheet feeding speed has not reached the selected speed, step 216 (FIG. 3), then, the program 200 continuously loops through the inquiry step 216 until the selected sheet feeding speed has been reached. Whereupon, the program implements the step 218 of causing the solenoid 140 (FIG. 2) to be deenergized for example, by deenergizing the power amplifier 32, and returning processing to idle 206. Alternatively, after implementation of step 214, the program 200 may implement the step 220 of maintaining the solenoid 140 operated for a time interval which is predetermined to be sufficient to permit the sheet feeding structure 16 to drive the sheet feed rollers 162 at the selected speed for feeding cut tapes 118 from the receptacle 82. Whereupon, the program 200 then implements the step 218 of causing the solenoid 140 to be deenergized, followed by returning processing to idle 206. Thus energization of the power amplifier 32 and operation of the solenoid 140 is discontinued at the end of the predetermined time interval. In either embodiment, energization of the solenoid 140 (FIG. 2) causes the spring 148 to be compressed as energy is stored therein and the tape feeding rollers 116 remain stationary. Accordingly, when the energization of the solenoid 140 is discontinued, the expanding spring 148 drives the rack gear 126 for rotating the pinion gear 124, clutch 118 and roller 116, for causing the roller 116 to feed a cut tape 118 from the receptacle 82, via the receptacle's aperture 94, and into the nip 160 of the sheet feeding rollers 162 for transport thereby in the path of travel 36 to the printing structure 50 of the postage meter 114.

In accordance with the objects of the invention there has been described a mailing machine including improved cut tape dispensing apparatus and, more particularly, a mailing machine base including cut tape dispensing apparatus and structure for operation thereof.

What is claimed is:

1. Apparatus for dispensing a cut tape comprising:

a. means for receiving a cut tape;

b. means for feeding the cut tape from the receiving means, the feeding means including a solenoid operable for causing the feeding means to feed the cut tape, the feeding including a roller disposed in feeding engagement with the cut tape, the feeding means including a pinion gear, the feeding means including a one-way clutch connected between the pinion gear and roller, the feeding means including a rack gear connected to the solenoid and disposed in meshing engagement with pinion gear for rotation thereof but not of the roller when the solenoid is energized; and c. means for controlling the feeding means, the controlling means including a microprocessor, the solenoid electrically connected to the microprocessor, the controlling means including a switch electrically connected to the microprocessor, and the microprocessor programmed for causing the solenoid to operate in response to actuation of the switch.

2. The apparatus according to claim 1, wherein the switch is manually actuatable for providing a signal to the microprocessor to cause the microprocessor to operate the solenoid.

3. The apparatus according to claim 2, wherein the controlling means includes means for causing the solenoid to operate, the solenoid operating means including a power amplifier electrically connected between the microprocessor and solenoid, and the microprocessor programmed for causing the power amplifier and thus the solenoid to operate for a time interval in response to receiving the signal.

4. The apparatus according to claim 3, wherein said feeding means is a first feeding means, said apparatus including second means for feeding the cut tape away from the cut tape dispensing apparatus, the microprocessor programmed for commencing operation of the second feeding means in response to the signal, and the time interval being sufficient to permit the second feeding means to attain a feeding speed sufficient to feed the cut tape away from the dispensing apparatus.

5. The apparatus according to claim 3, wherein the time interval is predetermined.

6. Apparatus for dispensing a cut tape comprising:

a. means for receiving a cut tape;

b. means for feeding the cut tape from the receiving means, the feeding means including a solenoid operable for causing the feeding means to feed the cut tape, the feeding means including a roller disposed in feeding engagement with the cut tape, the feeding means including a pinion gear connected to the roller, the feeding means including a rack gear disposed in meshing engagement with the pinion gear, the solenoid including a plunger connected to the rack gear, the feeding means including a spring coaxially mounted on the plunger, the solenoid compressing the spring to store energy therein when the solenoid is energized, the spring driving the rack gear for rotating the pinion gear and thus the roller when energization of the solenoid is discontinued c. means for controlling the feeding means, the controlling means including a microprocessor, the solenoid electrically connected to the microprocessor, the controlling means including a switch electrically connected to the microprocessor, and the microprocessor programmed for causing the solenoid to operate in response to actuation of the switch.

7. The apparatus according to claim 6, wherein said switch is connected to the dispensing apparatus and manually actuatable for providing a signal to the microprocessor to cause the microprocessor to operate the solenoid.

8. A mailing machine base comprising:

a. cut tape dispensing apparatus including i. framework defining a receptacle for receiving a cut tape, ii. a roller rotatably connected to the framework and disposed in feeding engagement with the cut tape, iii. a pinion gear connected to the roller for rotation thereof, iv. a rack gear movably connected to the framework and disposed in meshing engagement with the pinion gear, and v. a solenoid including a plunger connected to the rack gear for movement thereof, a spring coaxially mounted on the plunger and compressed thereby when the solenoid is energized, and the spring expanding to rotate the pinion gear and thus the roller to feed a cut tape from the receptacle when energization of the solenoid is discontinued;

b. a switch which is manually actuatable for providing a signal;

c. a microprocessor programmed for controlling the mailing machine base, the switch electrically connected to the microprocessor for providing the signal thereto;

d. a power amplifier connected to the microprocessor for operation thereby, and the microprocessor programming causing the power amplifier to energize the solenoid for a time interval after the switch provides the signal to the microprocessor.

9. The mailing machine base according to claim 8, including means for feeding the cut tape away from the cut tape dispensing apparatus, the microprocessor programming commencing operation of the feeding means in response to the signal, and the time interval being sufficient to permit the feeding means to attain a feeding speed sufficient to feed the cut tape away from the dispensing apparatus.

10. The apparatus according to claim 9, including a one-way clutch connected between the pinion gear and roller to permit the rack gear to rotate the pinion gear but not the roller when the solenoid is energized.

11. The apparatus according to claim 9, wherein the time interval is predetermined.

12. The apparatus according to claim 9, wherein the microprocessor programming determines when the time interval is ended.

13. The apparatus according to claim 8, wherein the switch is connected to the framework of the dispensing apparatus.

* * * * *